US009782890B2

(12) United States Patent
Hsieh

(10) Patent No.: US 9,782,890 B2
(45) Date of Patent: Oct. 10, 2017

(54) TOOL STORAGE DEVICE

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 15/234,241

(22) Filed: Aug. 11, 2016

(65) Prior Publication Data

US 2017/0043475 A1 Feb. 16, 2017

(30) Foreign Application Priority Data

Aug. 12, 2015 (CN) ..... 2015 1 0492560

(51) Int. Cl.
*B65D 85/28* (2006.01)
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC ..... B25H 3/003; B25H 3/04
USPC ..... 206/349, 372, 378, 379; 211/70.6
See application file for complete search history.

(56) References Cited

U.S. PATENT DOCUMENTS 5,467,874 A * 11/1995 Whitaker ..... B25H 3/06 206/378
6,070,745 A * 6/2000 Dembicks ..... B25H 3/06 206/378
6,415,933 B1 * 7/2002 Kao ..... B25H 3/003 206/378
6,450,338 B1 * 9/2002 Chen ..... B25H 3/003 206/378
6,488,151 B2 * 12/2002 Ramsey ..... B25H 3/06 206/378
7,841,480 B2 * 11/2010 Hsieh ..... B25H 3/06 206/378
9,186,790 B1 * 11/2015 Kao ..... B25H 3/06
2005/0218023 A1 * 10/2005 Winnard ..... B25H 3/003 206/378
2016/0096264 A1 * 4/2016 Kao ..... B25H 3/06 206/378

* cited by examiner

*Primary Examiner* — Luan K Bui
(74) *Attorney, Agent, or Firm* — Burris Law, PLLC

(57) ABSTRACT

A tool storage device includes a platform and a fastening seat. The platform has a first guide structure. The fastening seat has a first standing wall, a tongue projecting from the first standing wall, a second standing wall, and an interconnecting segment interconnecting the first and second standing walls. The fastening seat is rotatable relative to the platform between a first position where the first segment engages the first guide structure, and a second position where a distance between an end of the tongue which is opposite to the second standing wall and a center of gravity of the second standing wall varies from that when the fastening seat is at the first position.

6 Claims, 13 Drawing Sheets

TOOL STORAGE DEVICE

CROSS-REFERENCE TO RELATED APPLICATION

This application claims priority to Chinese Patent Application Serial No. 201510492560.8, filed on Aug. 12, 2015.

FIELD

The disclosure relates to a storage device, more particularly to a tool storage device.

BACKGROUND

Referring to FIGS. 1 and 2, a conventional tool holder disclosed in Taiwanese patent No. 1343306 is adapted to removably hold a socket 6 thereon. The conventional tool holder includes a frame body 1, a bottom seat 2 mounted to the frame body 1, a movable seat 3 rotatably mounted on the bottom seat 2, a spring 4 resiliently interconnecting the bottom seat 2 and the movable seat 3, and a ball 5.

The frame body 1 has two spaced-apart abutment walls 101. The bottom seat 2 has a post 201 formed with a cavity 202. The movable seat 3 has a sleeve 301 sleeved on the post 201 and formed with a hole 303, and a disc 305 connected to a bottom end of the sleeve 301 and formed with two protrusions 302. The spring 4 has opposite ends abutting respectively and resiliently against the bottom seat 2 and the disc 305. The ball 5 engages movably the hole 303.

As shown in FIG. 1, when the movable seat 3 is at a position where the protrusions 302 are away from the abutment walls 101, the hole 303 of the sleeve 301 is registered with a shallow portion of the cavity 202 of the post 201, so that a portion of the ball 5 is pushed out of the hole 303 by the post 201 to engage a groove 601 of the socket 6, thereby securing the socket 6 on the conventional tool holder. As shown in FIG. 2, when the movable seat 3 is turned to a position where the protrusions 302 respectively contact the abutment walls 101, the movable seat 3 is simultaneously moved downwardly and the hole 303 of the sleeve 301 is registered with a deep portion of the cavity 202 of the post 201, so that the ball 5 can retract from the hole 303 and be disengaged from the groove 601 of the socket 6, thereby permitting removal of the socket 6 from the conventional tool holder.

However, the conventional tool holder has a relatively complicated structure, and when assembling of the conventional tool holder, the ball 5 has to be placed manually in the hole 303, and the spring 4 has to be placed manually between the bottom seat 2 and the movable seat 3, thereby resulting in a relatively high manufacturing cost.

SUMMARY

Therefore, the object of the disclosure is to provide a tool storage device that has a simple structure and that is easy to be assembled.

Accordingly, a tool storage device includes a platform and a fastening seat. The platform includes a first guide structure. The fastening seat has a first segment, a second segment, and an interconnecting segment. The first segment has a first standing wall that extends in an extending direction, and a tongue that projects from the first standing wall. The second segment is spaced apart from the first segment, and has a second standing wall that extends in the extending direction. The first standing wall has an inner surface that faces the second standing wall, and an outer surface that is opposite to the inner surface. The tongue projects from the outer surface of the first standing wall. The interconnecting segment interconnects the first and second standing walls. The fastening seat is rotatable relative to the platform about an axis that extends in the extending direction between a first position, where the first segment engages the first guide structure, and a second position, where a distance between an end of the tongue which is opposite to the second standing wall and a center of gravity of the second segment varies from that when the fastening seat is at the first position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
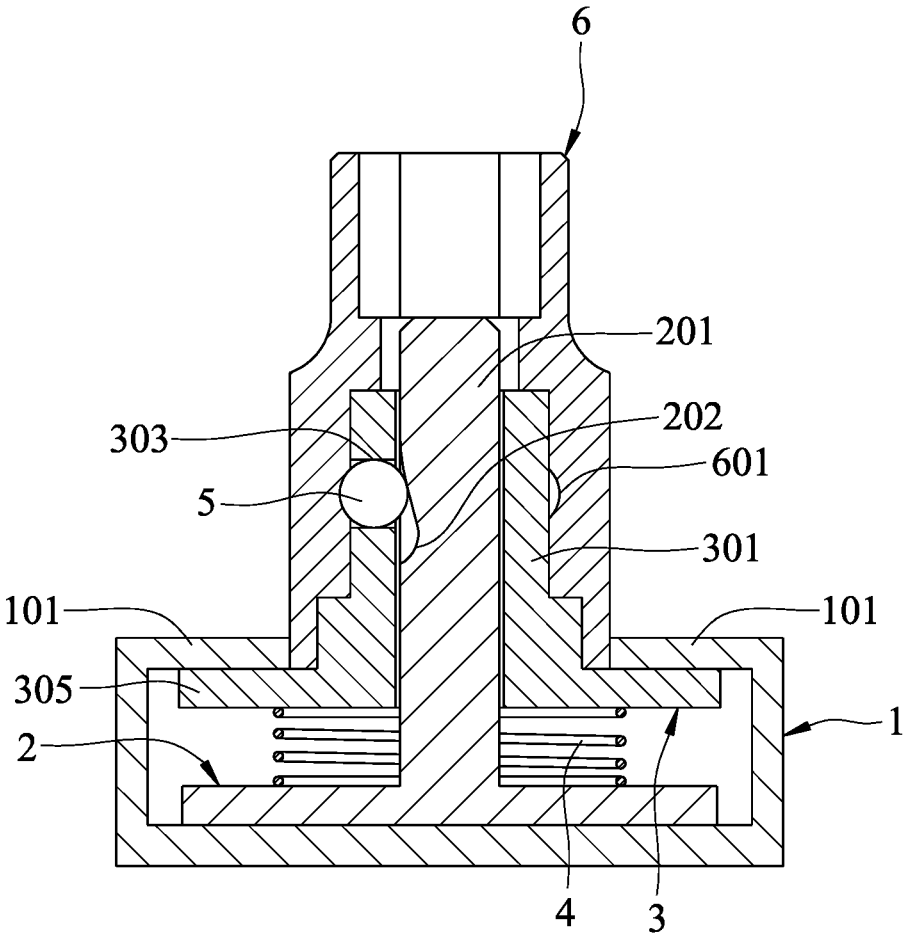
FIG.1 PRIOR ART
FIG. 1 is a sectional view of a conventional tool holder disclosed in Taiwanese patent No. I343306 with a socket being held thereon.
Figure 2:
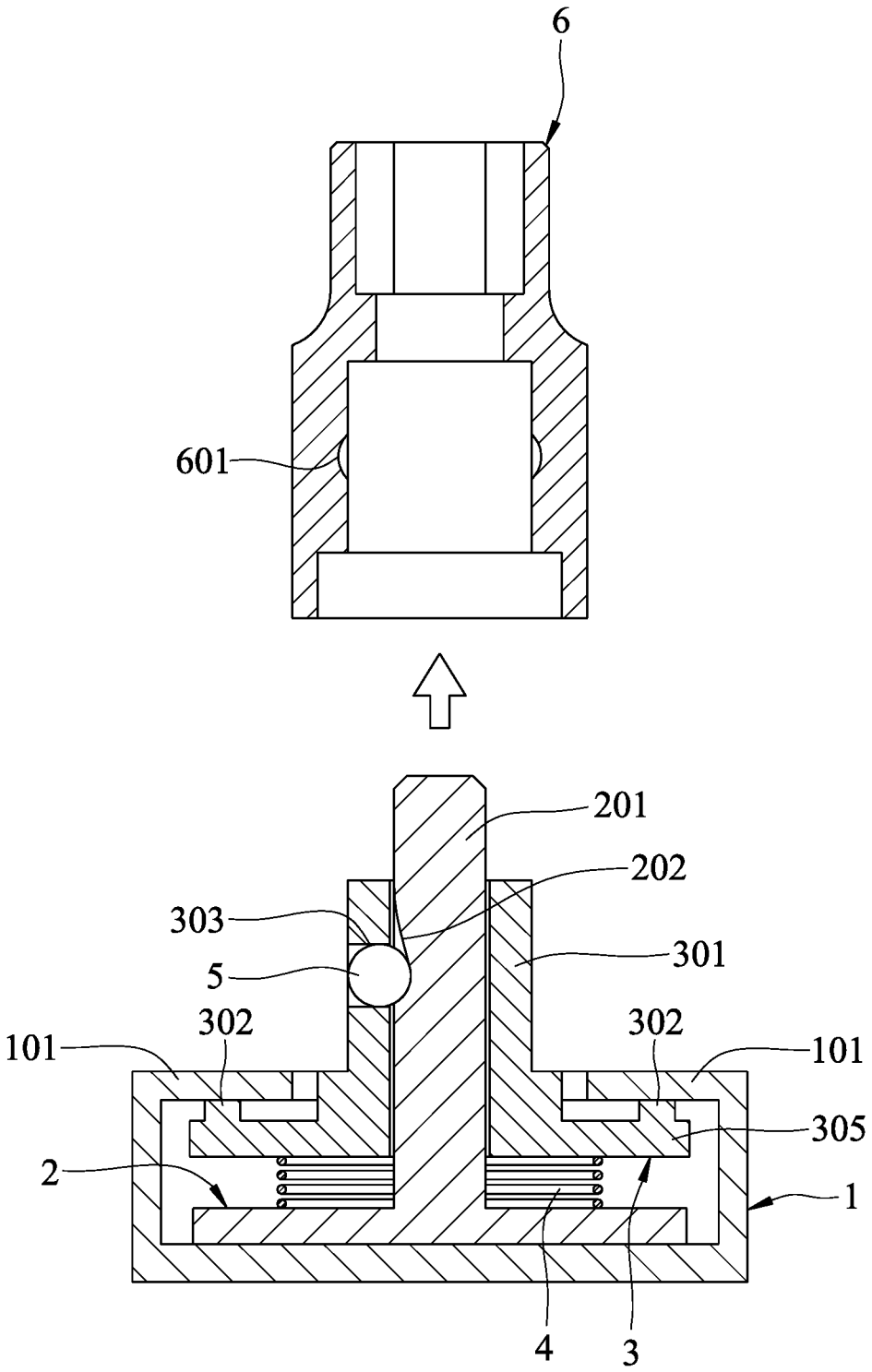
FIG.2 PRIOR ART
FIG. 2 is a sectional view of the conventional tool holder disclosed in Taiwanese patent No. I343306 with the socket being removed therefrom.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 3:
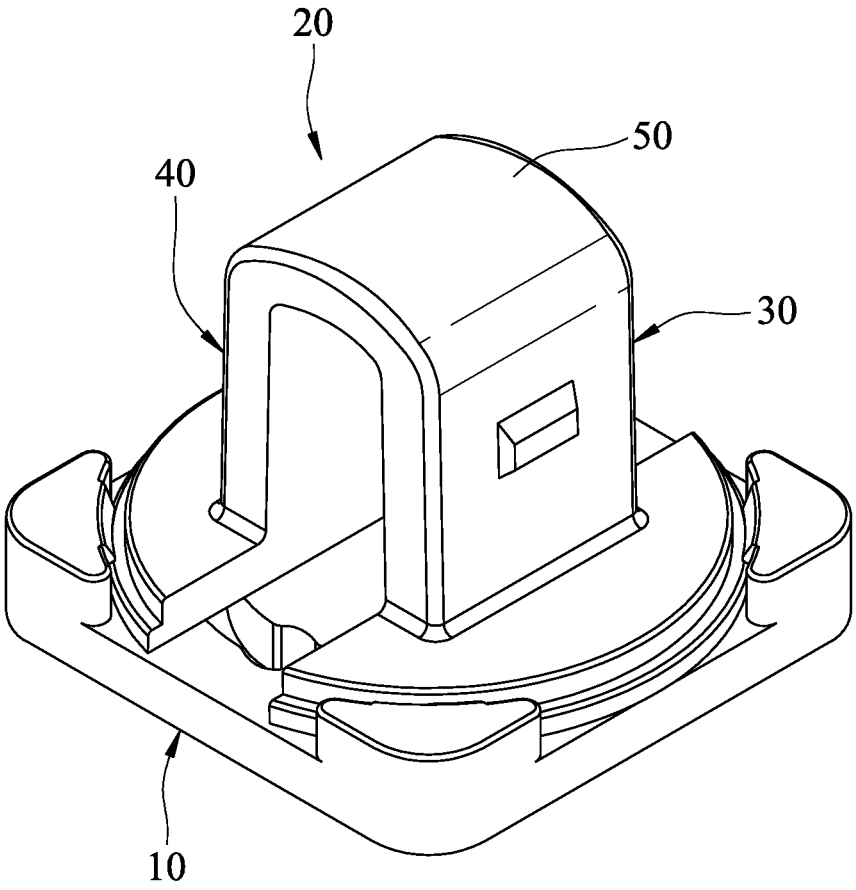
FIG. 3 is an assembled perspective view illustrating a first embodiment of a tool storage device according to the disclosure.
Figure 4:
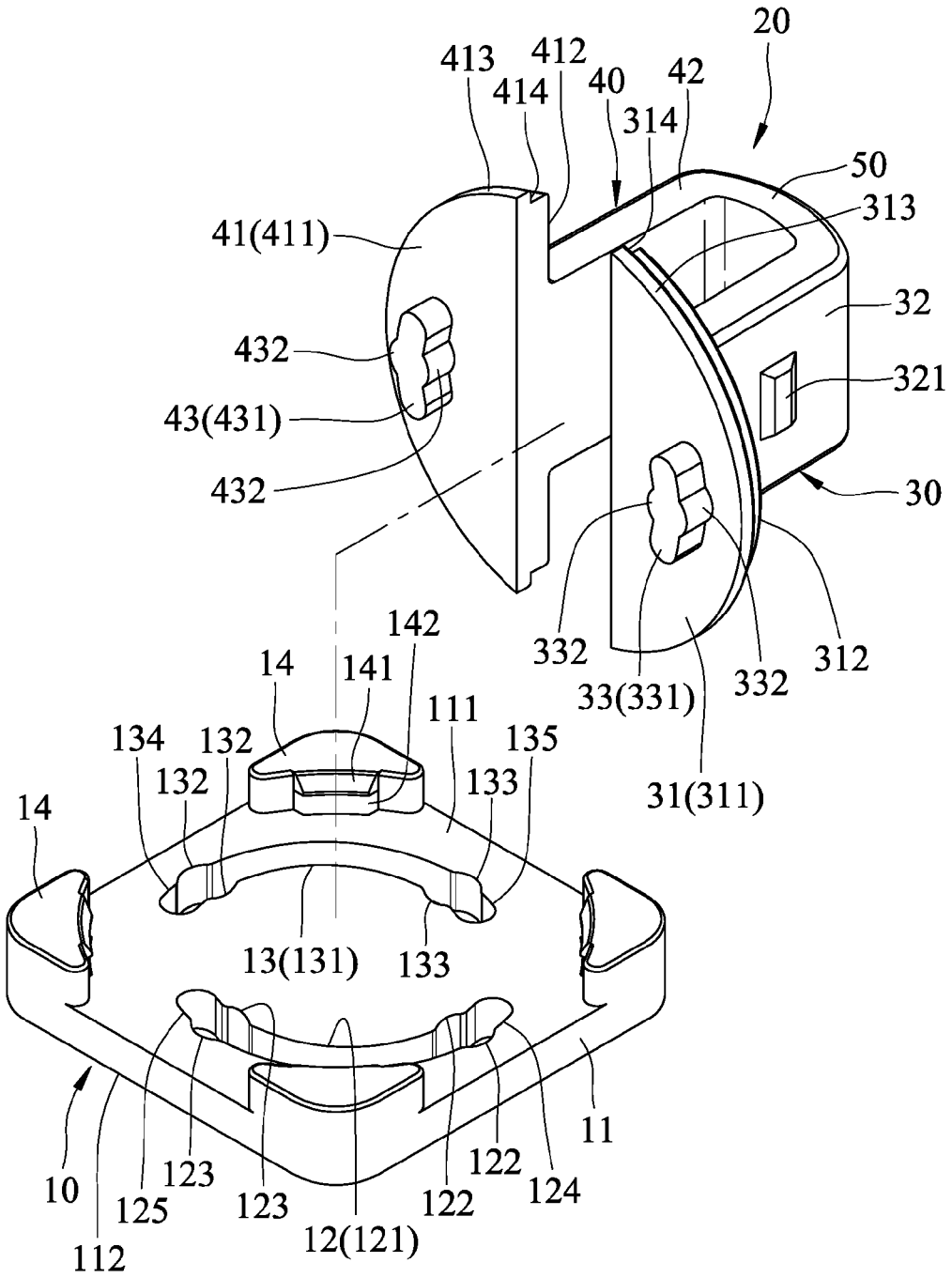
FIG. 4 is an exploded perspective view of the first embodiment.

Referring to FIGS. 3 and 4, a first embodiment of a tool storage device according to the present disclosure is illustrated. The tool storage device is adapted to fasten and store a tool 100 (see FIG. 6) thereon. In this embodiment, the tool 100 is a socket, and has an internal surface formed with an engaging groove 110. The tool storage device includes a platform 10, and a fastening seat 20 rotatably mounted on the platform 10.

In this embodiment, the platform 10 includes a bottom wall 11, a first guide structure 12, a second guide structure 13, and four projections 14.

Figure 5:
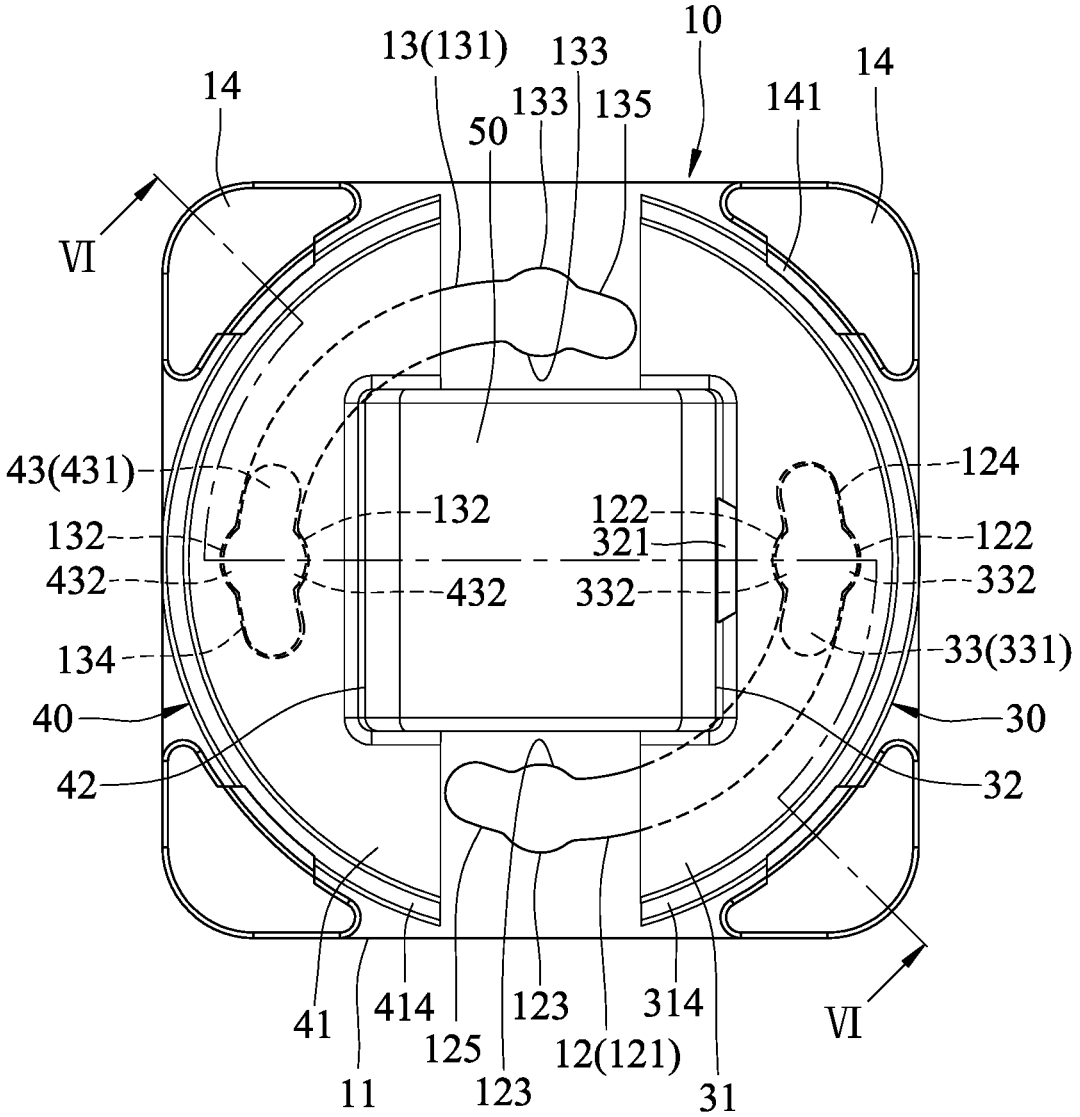
FIG. 5 is a top view of the first embodiment, illustrating the fastening seat at a first position.
Figure 6:
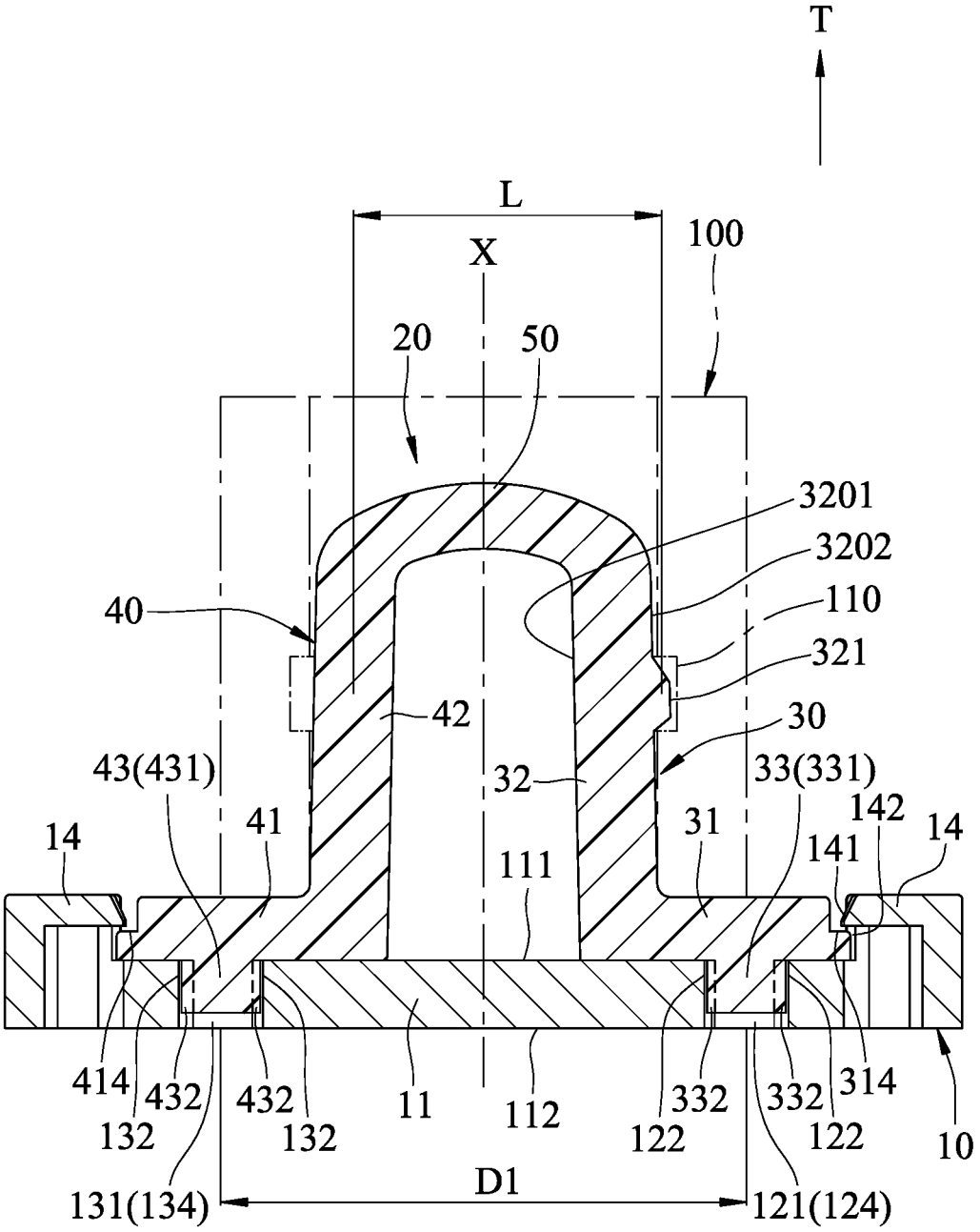
FIG. 6 is an offset sectional view of the first embodiment taken along line VI-VI in FIG. 5.

Referring further to FIGS. 5 and 6, the bottom wall 11 is perpendicular to an axis (X) which extends in an extending direction (T), and has a top surface 111 and a bottom surface 112 opposite to each other along the axis (X). In this embodiment, the top surface 111 is a rectangular surface.

The first guide structure 12 has a first groove 121 formed through the top and bottom surfaces 111, 112 and has opposite first hold and first release ends 124, 125, two first hold slots 122 formed through the top and bottom surfaces 111, 112 and being in spatial communication with the first hold end 124, and two first release slots 123 also formed through the top and bottom surface 111, 112 and being in spatial communication with the first release end 125.

The second guide structure 13 has a second groove 131 formed through the top and bottom surfaces 111, 112 and has opposite second hold and second release ends 134, 135, two second hold slots 132 formed through the top and bottom surfaces 111, 112 and being in spatial communication with the second hold end 134, and two second release slots 133 also formed through the top and bottom surface 111, 112 and being in spatial communication with the second release end 135.

Figure 8:
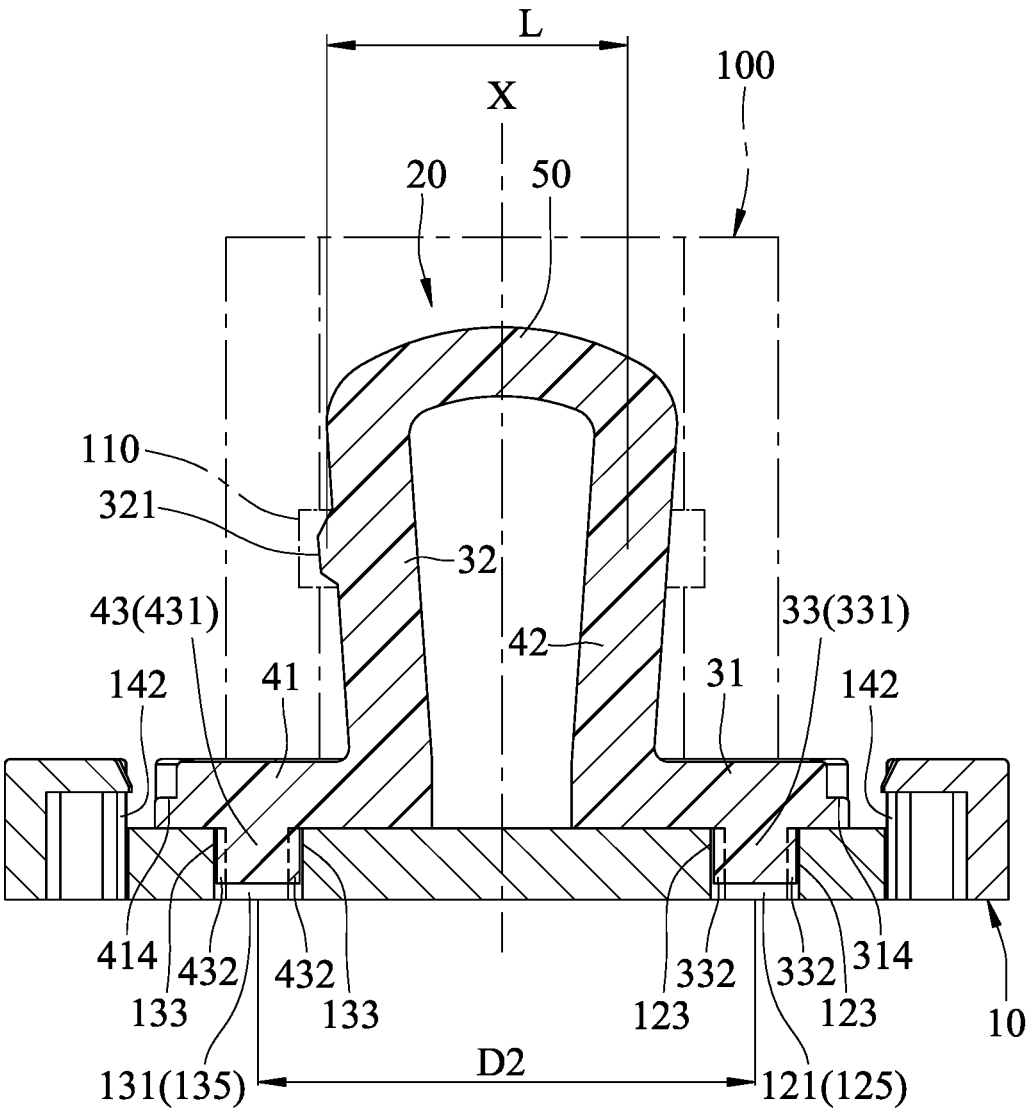
FIG. 8 is an offset sectional view of the first embodiment taken along line VIII-VIII in FIG. 7.

As shown in FIGS. 6 and 8, a distance (D1) between a center of the first hold end 124 and a center of the second hold end 134 is larger than a distance (D2) between a center of the first release end 125 and a center of the second release end 135.

As shown in FIGS. 4 and 6, the projections 14 are respectively disposed at four corners of the rectangular top surface 111 of the bottom wall 11. Each of the projections 14 has a stem portion 140 projecting from the top surface 111, and a positioning portion 141 protruding from the stem portion 140 and cooperating with the top surface 111 to define a guide groove 142 therebetween.

The fastening seat 20 has a first segment 30, a second segment 40 spaced apart from the first segment 30, and an interconnecting segment 50 interconnecting the first and second segments 30, 40.

The first segment 30 has a first standing wall 32 that extends in the extending direction (T) and that has opposite inner and outer surfaces 3201, 3202, a tongue 321 that projects transversely from the outer surface 3202 of the first standing wall 32, a first base wall 31 that is connected to the first standing wall 32 and that is disposed on the top surface 111 of the platform 10, and a first slide structure 33 that is connected to the first base wall 31.

The second segment 40 has a second standing wall 42 that extends in the extending direction (T), a second base wall 41 that is connected to the second standing wall 42 and that is disposed on the top surface 111 of the platform 10, and a second slide structure 43 that is connected to the second base wall 42. The inner surface 3201 of the first standing wall 32 faces the second standing wall 42, and the tongue 321 is opposite the second standing wall 42.

In this embodiment, the interconnecting segment 50 and the first and second standing walls 32, 42 are molded as one piece.

Figure 7:
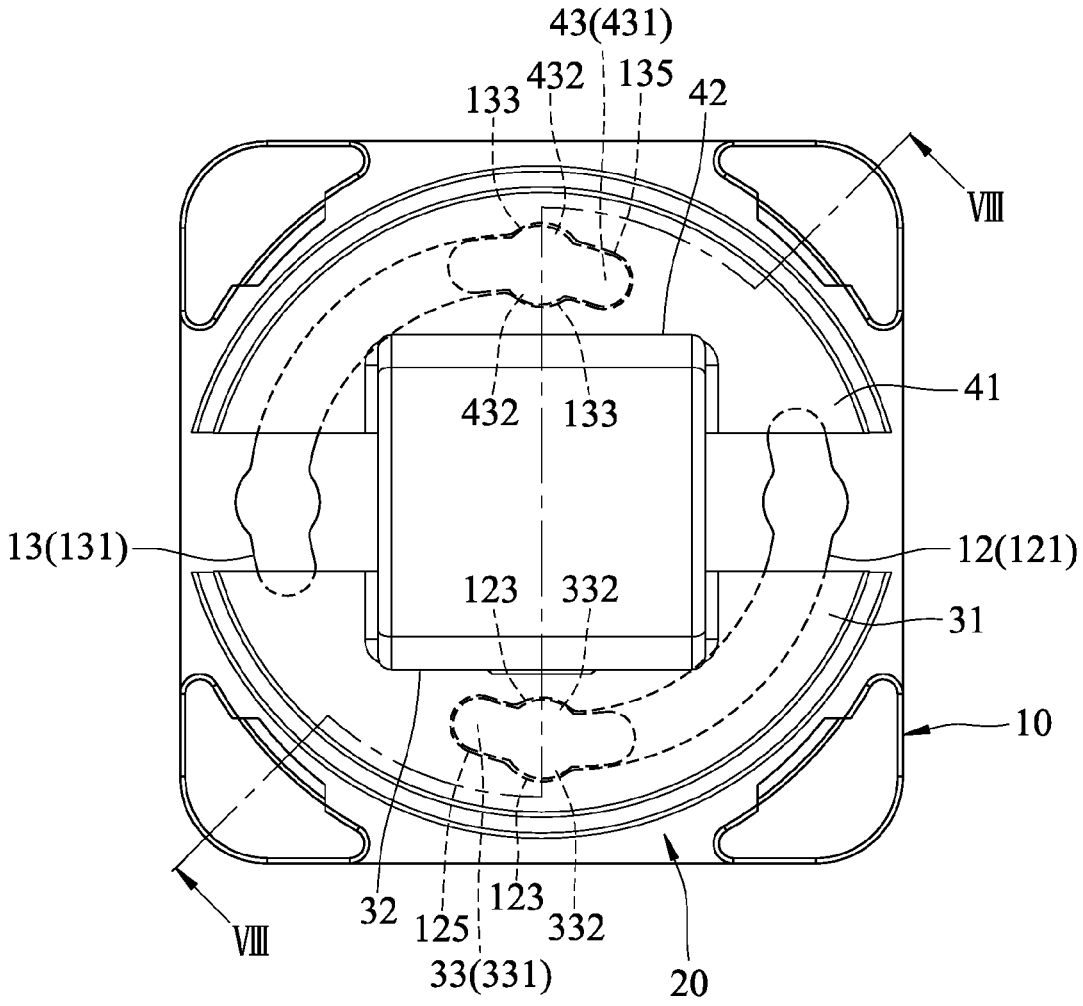
FIG. 7 is a view similar to FIG. 5, but illustrating the fastening seat at a second position.

The fastening seat 20 is rotatable relative to the platform 10 about the axis (X) between a first position (see FIGS. 5 and 6), and a second position (see FIGS. 7 and 8).

Specifically, each of the first and second base walls 31, 41 has a bottom wall face 311, 411 abutting slidably against the top surface 111 of the bottom wall 11 of the platform 10, a top wall face 312, 412 opposite to the bottom wall face 311, 411, and a surrounding wall face 313, 413 interconnecting the top wall face 312, 412 and the bottom wall face 311, 411 and formed with a stepped section 314, 414. The first slide structure 33 has a first slide block 331 projecting from the bottom wall face 311 of the first base wall 31 and engaging slidably the first groove 121, and two first positioning blocks 332 protruding from the first slide block 331. The second slide structure 43 has a second slide block 431 projecting from the bottom wall face 411 of the second base wall 41 and engaging slidably the second groove 131, and two second positioning blocks 432 protruding from the second slide block 431. When the fastening seat 20 is at the first position, the first and second slide blocks 331, 431 engage respectively the first hold end 124 of the first groove and the second hold end 134 of the second groove 131, the first positioning blocks 332 engage respectively the first hold slots 122 of the first guide structure of the platform 10, and the second positioning blocks 432 engage respectively the second hold slots 132 of the second guide structure 13 of the platform 10. When the fastening seat 20 is at the second position, the first and second slide blocks 331, 431 engage respectively the first release end 125 of the first groove 121 and the second release end 135 of the second groove 131, the first positioning blocks 332 engage respectively the first release slots 123 of the first guide structure 12, and the second positioning blocks 432 engage respectively the second release slots 133 of the second guide structure 13. Moreover, one of the stepped sections 314, 414 of the surrounding wall faces 313, 413 of the first and second base walls 31, 41 engages two of the guide grooves 142 when the fastening seat 20 is at the first position, and is disengaged from the two of the guide grooves 142 when the fastening seat 20 is at the second position. The other one of the stepped sections 314, 414 of the surrounding wall faces 313, 413 of the first and second base walls 31, 41 engages the other two of the guide grooves 142 when the fastening seat 20 is at the first position, and is disengaged from the other two of the guide grooves 142 when the fastening seat 20 is at the second position. Furthermore, by virtue of the configuration of the first and second guide structures 12, 13 of the platform 10, a distance (L) (see FIGS. 6 and 8) between an end of the tongue 321 which is opposite to the second standing wall 42 and a center of gravity of the second segment 40 decreases when the fastening seat 20 is rotated from the first position to the second position.

In use, when the tool 100 is placed by a user to surround the fastening seat 20, and the fastening seat 20 is rotated to the first position, the tongue 321 engages the engaging groove 110 of the tool 100, so that the tool 100 is fastened and stored on the tool storage device, as shown in FIG. 6. When the fastening seat 20 is rotated from the first position to the second position, with the distance (L) being decreased, the tongue 321 is disengaged from the engaging groove 110 of the tool 100, so that the tool 100 is permitted to be removed from the fastening seat 20, as shown in FIG. 8.

Therefore, with only two elements (i.e., the platform 10 and the fastening seat 20) being coupled together, the tool storage device according to the disclosure has a simpler structure than that of the abovementioned prior art, thereby resulting in a lower manufacturing cost.

Figure 9:
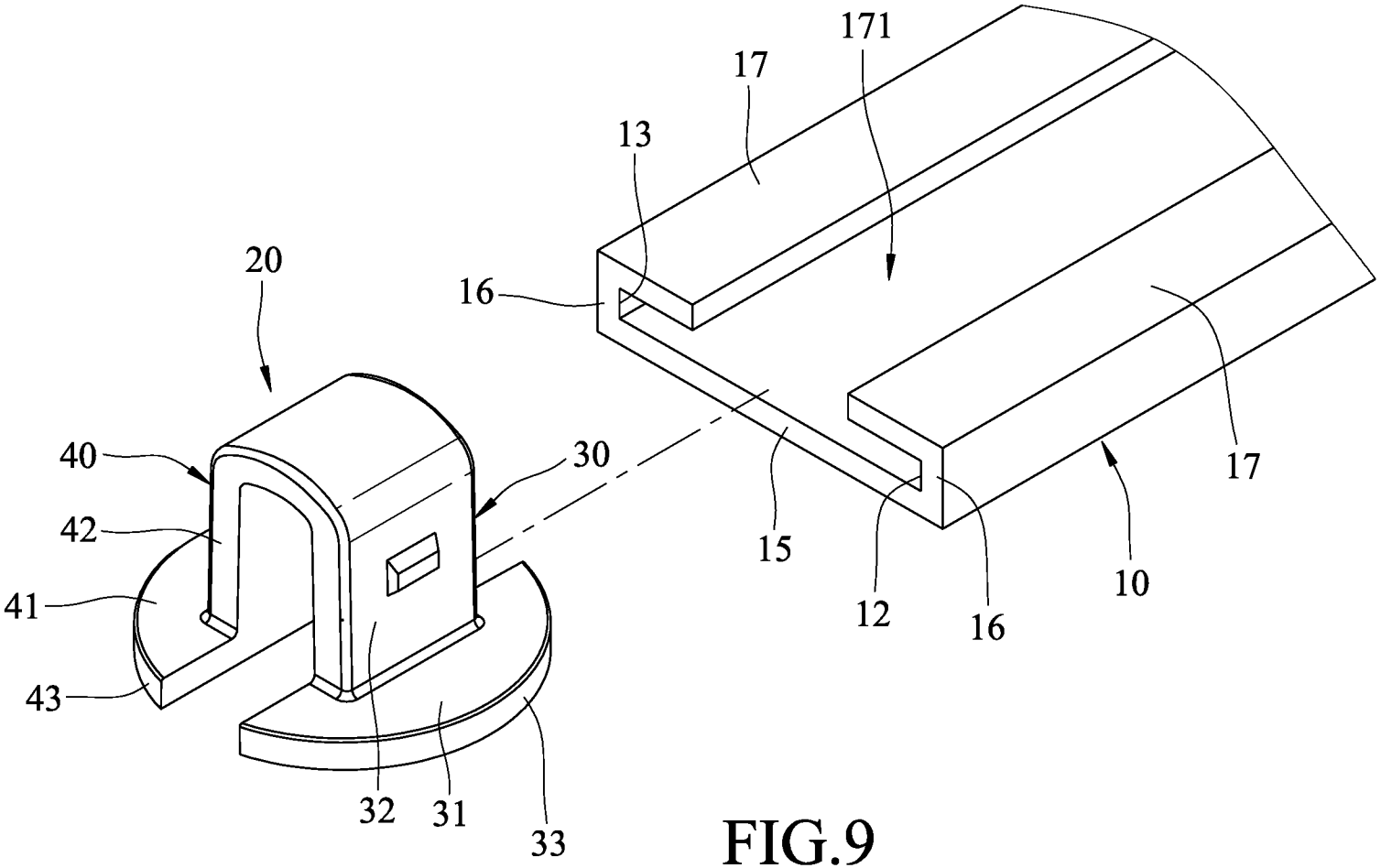
FIG. 9 is an exploded perspective view illustrating a second embodiment of the tool storage device according to the disclosure.
Figure 10:
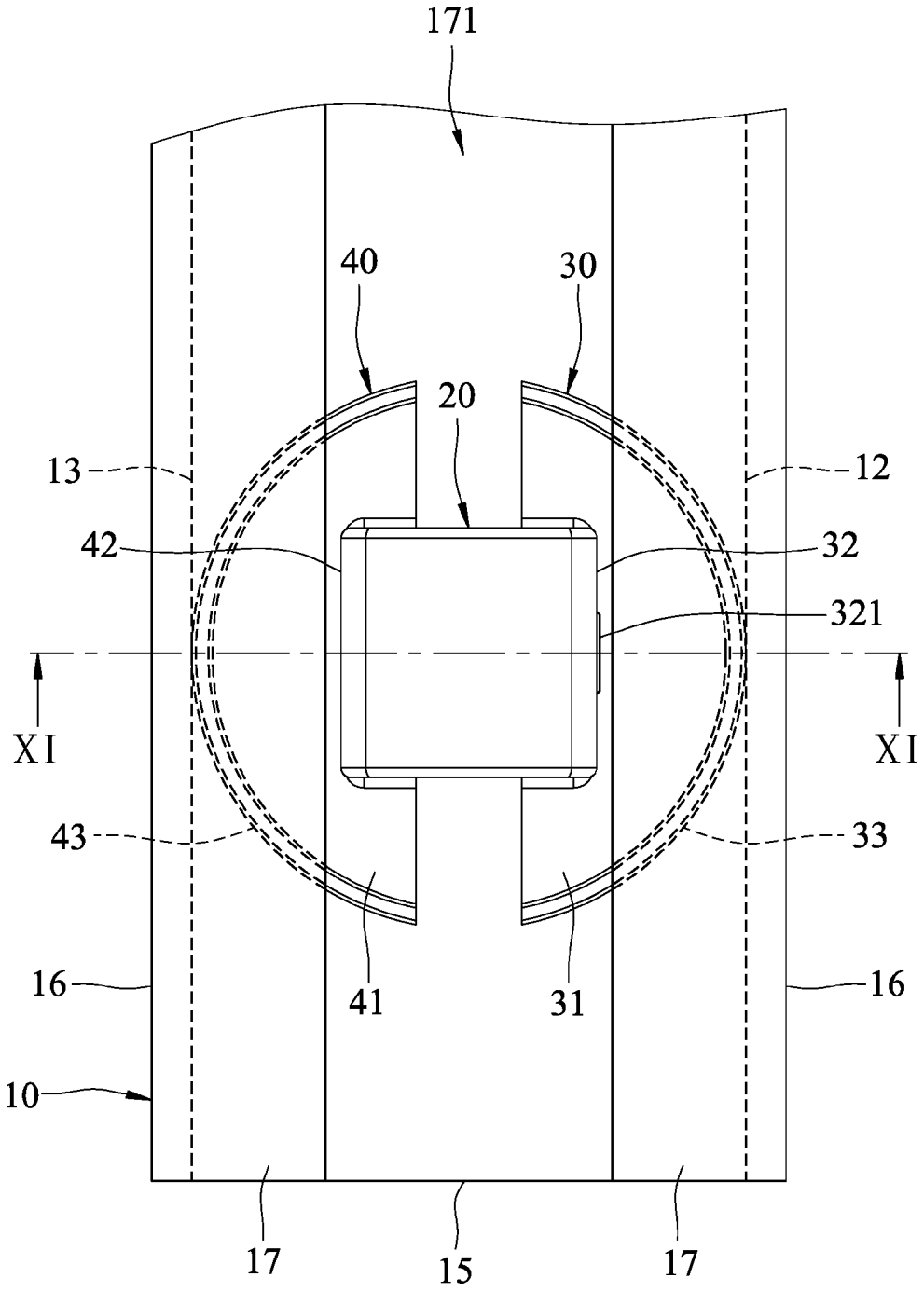
FIG. 10 is a top view of the second embodiment, illustrating the fastening seat at a first position.
Figure 11:
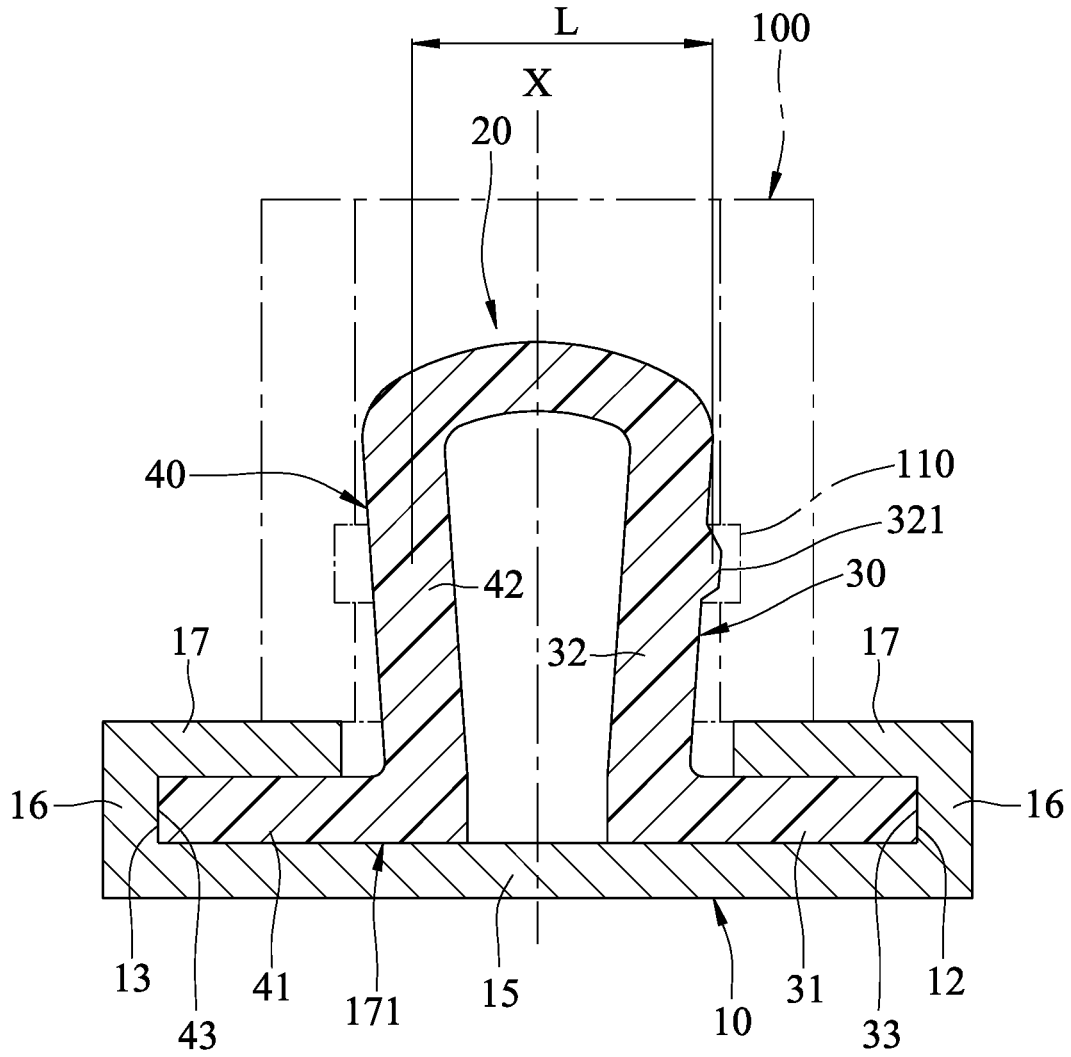
FIG. 11 is a sectional view of the second embodiment taken along line XI-XI in FIG. 10.

Referring to FIGS. 9 to 11, a second embodiment of the tool storage device according to the disclosure has a structure similar to that of the first embodiment. The difference between the second embodiment and the first embodiment resides in the following.

In the second embodiment, the platform 10 includes an elongated base wall 15 perpendicular to the extending direction (T), two side walls 16 extending transversely and respectively from opposite elongated edges of the base wall 15, and two abutment walls 17 extending respectively from top edges of the side walls 16 toward each other, and cooperating with the base wall 11 and the side walls 16 to define an inverted T-shaped slide groove 171. Moreover, one of the side walls 16 has an inner surface facing the slide groove 171 and serving as the first guide structure 12, and the other one of the side walls 16 also has an inner surface facing the slide groove 171 and serving as the second guide structure 13. Each of the inner surfaces of the abutment walls 17 is formed as a flat surface.

In the second embodiment, the standing walls 32, 42 of the first and second segment 30, 40 of the fastening seat 20 extend respectively in the extending direction (T) outwardly of the sliding groove 171. The first base wall 31 is disposed slidably in the slide groove 171, and the first slide structure 33 is configured as a portion of a lateral surface of the first base wall 31. The second base wall 41 is disposed slidably in the slide groove 171, and the second slide structure 43 is configured as a portion of a lateral surface of the second base wall 42. Each of the portion of the lateral surface of the first base wall 31 and the portion of the lateral surface of the second base wall 41 is formed as a curved surface.

Figure 12:
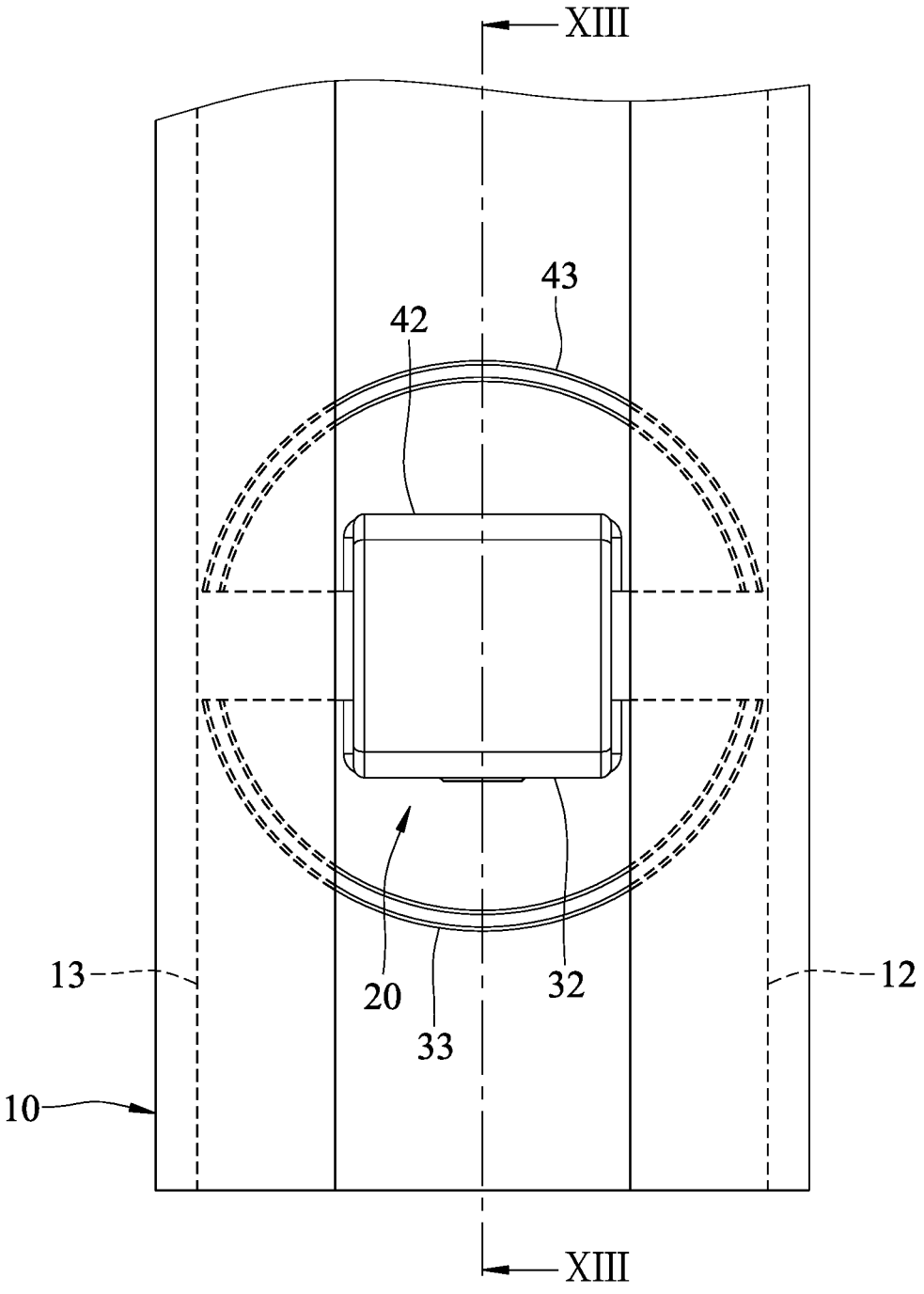
FIG. 12 is a view similar to FIG. 10, but illustrating the fastening seat at a second position.
Figure 13:
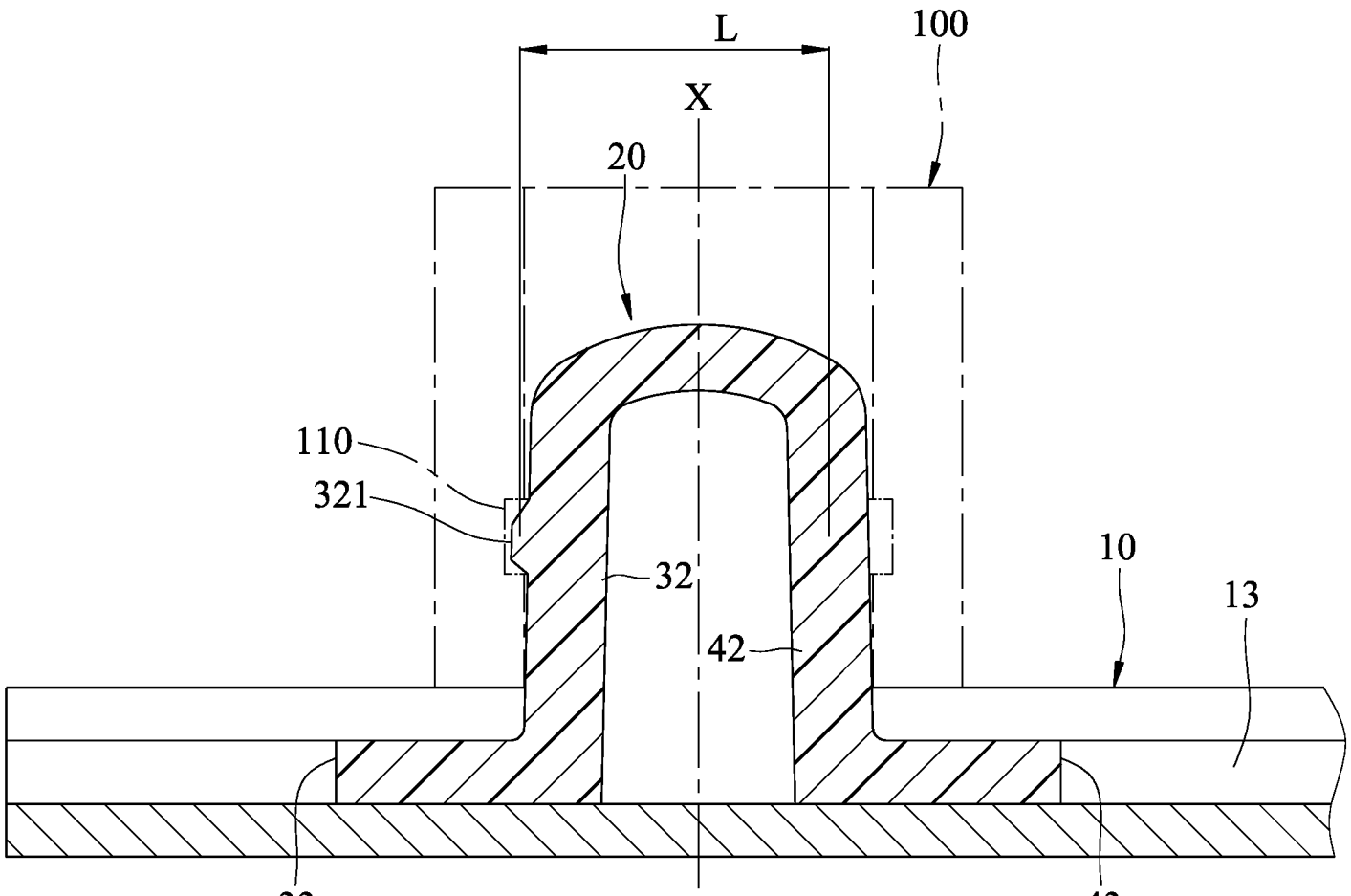
FIG. 13 is a sectional view of the second embodiment taken along line XIII-XIII in FIG. 12.

With the foregoing structure in the second embodiment, the fastening seat 20 is rotatable relative to the platform 10 about the axis (X) (see FIG. 11) between a first position (see FIGS. 10 and 11), where the first and second slide structures 33, 43 abut respectively against the first and second guide structures 12, 13, and a second position (see FIGS. 12 and 13), where the first and second slide structures 33, 43 are separated from the first and second guide structures 12, 13. The distance (L) between the end of the tongue 321 and the center of gravity of the second segment 40 is configured to increase when the fastening seat 20 is rotated from the first position to the second position. As such, the tool 100 can be held on and removed from the fastening seat 20 in the same manner as the first embodiment.

In the description above, for the purposes of explanation, numerous specific details have been set forth in order to provide a thorough understanding of the embodiment (s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A tool storage device comprising:

a platform that includes a first guide structure; and a fastening seat that has a first segment having a first standing wall that extends in an extending direction, and a tongue that projects from said first standing wall, a second segment spaced apart from said first segment and having a second standing wall that extends in the extending direction, said first standing wall having an inner surface that faces said second standing wall and an outer surface that is opposite to said inner surface, said tongue projecting from said outer surface of said first standing wall, and an interconnecting segment interconnecting said first and second standing walls;

said fastening seat being rotatable relative to said platform about an axis that extends in the extending direction between a first position, where said first segment engages said first guide structure, and a second position, where a distance between an end of said tongue which is opposite to said second standing wall and a center of gravity of said second segment varies from that when said fastening seat is at the first position;

wherein said platform further includes a second guide structure that engages said second segment when said fastening seat is at the first position;

wherein said first segment further has a first base wall connected to said first standing wall and disposed on said platform, and a first slide structure connected to said first base wall and movably engaging said first guide structure when said fastening seat is at the first and second positions;

wherein said second segment further has a second base wall connected to said second standing wall and disposed on said platform, and a second slide structure connected to said second base wall and movably engaging said second guide structure when said fastening seat is at the first and second positions;

wherein said platform further includes a bottom wall perpendicular to the axis and having a top surface and a bottom surface;

wherein said first guide structure has a first groove formed through said top and bottom surfaces, and having a first hold end, and a first release end that is opposite to said first hold end;

wherein said second guide structure has a second groove formed through said top and bottom surfaces, and having a second hold end, and a second release end that is opposite to said second hold end;

wherein a distance between a center of said first hold end and a center of said second hold end is larger than a distance between a center of said first release end and a center of said second release end;

wherein each of said first and second base walls has a bottom wall face abutting slidably against said top surface of said bottom wall of said platform;

wherein said first slide structure has a first slide block projecting from said bottom wall face of said first base wall and engaging slidably said first groove;

wherein said second slide structure has a second slide block projecting from said bottom wall face of said second base wall and engaging slidably said second groove;

wherein, when said fastening seat is at the first position, said first and second slide blocks engage respectively said first hold end of said first groove and said second hold end of said second groove;

wherein, when said fastening seat is at the second position, said first and second slide blocks engage respectively said first release end of said first groove and said second release end of said second groove; and wherein the distance between the end of said tongue which is opposite to said second standing wall and the center of gravity of said second segment decreases when said fastening seat is rotated from the first position to the second position.

2. The tool storage device as claimed in claim 1, wherein:

said first guide structure of said platform further has two first hold slots formed through said top and bottom surfaces and being in spatial communication with said first hold end of said first groove, and two first release slots formed through said top and bottom surfaces and being in spatial communication with said first release end of said first groove;

said second guide structure of said platform further has two second hold slots formed through said top and bottom surfaces and being in spatial communication with said second hold end of said second groove, and two second release slots formed through said top and bottom surfaces and being in spatial communication with said second release end of said second groove;

said first slide structure of said first member further has two first positioning blocks protruding from said first slide block;

said second slide structure of said second member further has two second positioning blocks protruding from said second slide block;

when said fastening seat is at the first position, said first positioning blocks engage respectively said first hold slots of said first guide structure of said platform, and said second positioning blocks engage respectively said second hold slots of said second guide structure of said platform; and when said fastening seat is at the second position, said first positioning blocks engage respectively said first release slots of said first guide structure, and said second positioning blocks engage respectively said second release slots of said second guide structure.

3. The tool storage device as claimed in claim 2, wherein:

said platform further includes a plurality of projections, each of which has a stem portion projecting from said top surface of said bottom wall, and a positioning portion protruding from said stem portion, and cooperating with said top surface to define a guide groove therebetween; and each of said first and second base walls further has a top wall face opposite to said bottom wall face, and a surrounding wall face interconnecting said top wall face and said bottom wall face and formed with a stepped section;

when said fastening seat is at the first position, said stepped sections engage said guide grooves; and when said fastening seat is at the second position, said stepped sections are disengaged from said guide grooves.

4. The tool storage device as claimed in claim 3, wherein:

said top surface of said seat wall is a rectangular surface; and said platform includes four of said projections respectively disposed at four corners of said top surface.

5. A tool storage device comprising:

a platform that includes a first guide structure; and a fastening seat that has a first segment having a first standing wall that extends in an extending direction, and a tongue that projects from said first standing wall, a second segment spaced apart from said first segment and having a second standing wall that extends in the extending direction, said first standing wall having an inner surface that faces said second standing wall and an outer surface that is opposite to said inner surface, said tongue projecting from said outer surface of said first standing wall, and an interconnecting segment interconnecting said first and second standing walls;

said fastening seat being rotatable relative to said platform about an axis that extends in the extending direction between a first position, where said first segment engages said first guide structure, and a second position, where a distance between an end of said tongue which is opposite to said second standing wall and a center of gravity of said second segment varies from that when said fastening seat is at the first position;

wherein said platform further includes a second guide structure that engages said second segment when said fastening seat is at the first position;

wherein said platform further includes a base wall perpendicular to the extending direction, two side walls extending transversely and respectively from opposite edges of said base wall, and two abutment walls extending respectively from top edges of said side walls toward each other, and cooperating with said base wall and said side walls to define an inverted T-shaped slide groove;

wherein one of said side walls has an inner surface facing said slide groove and serving as said first guide structure;

wherein the other one of said side walls has an inner surface facing said slide groove and serving as said second guide structure;

wherein said first segment of said fastening seat further has a first base wall connected to said first standing wall and disposed slidably in said slide groove, and a first slide structure configured as a portion of a lateral surface of said first base wall; and wherein said second segment of said fastening seat further has a second base wall connected to said second standing wall and disposed slidably in said slide groove, and a second slide structure configured as a portion of a lateral surface of said second base wall;

wherein said first and second standing walls extend respectively in the extending direction outwardly of said sliding groove;

wherein, when said fastening seat is at the first position, said first and second slide structures abut respectively against said first and second guide structures;

wherein, when said fastening seat is at the second position, said first and second slide structures are separated from said first and second guide structures; and wherein the distance between the end of said tongue which is opposite to said second standing wall and the center of gravity of said second segment decreases when said fastening seat is rotated from the first position to the second position.

6. The tool storage device as claimed in claim 5, wherein:

each of said inner surfaces of said abutment walls is formed as a flat surface; and each of said portion of said lateral surface of said first base wall and said portion of said lateral surface of said second base wall is formed as a curved surface.

* * * * *